US006024864A

United States Patent [19]

Aldous et al.

[11] Patent Number: 6,024,864

[45] **Date of Patent: *Feb. 15, 2000**

[54] METHOD FOR MAKING A PROCESS OIL BY USING AROMATIC ENRICHMENT AND TWO PASS HYDROFINISHING

[75] Inventors: Keith Kaluna Aldous, League City; Jacob Ben Angelo, Spring, both of Tex.; Joseph Philip Boyle, Baton Rouge, La.; Bruce M. Jarnot, Martinsville, N.J.; Wayne E. Hanson, Baytown, Tex.

[73] Assignee: Exxon Research and Engineering Co, Florham Park, N.J.

[ * ] Notice: This patent is subject to a terminal disclaimer.

[21] Appl. No.: 09/215,613

[22] Filed: Dec. 17, 1998

Related U.S. Application Data

[63] Continuation-in-part of application No. 08/897,099, Jul. 18, 1997, Pat. No. 5,846,405.

[51] Int. Cl.[7] ..... C10G 73/06; C10G 1/04; C10G 45/00; C10G 17/04

[52] U.S. Cl. ..... 208/212; 208/31; 208/33; 208/87; 208/210; 208/211; 208/254 H; 208/303; 208/311

[58] Field of Search ..... 208/210, 211, 208/212, 31, 33, 87, 254 H, 311, 303

[56] References Cited

U.S. PATENT DOCUMENTS

| | | | |
|---|---|---|---|
| 2,307,130 | 1/1943 | Henry et al. | 196/18 |
| 5,840,175 | 11/1998 | Aldous et al. | 208/87 |
| 5,846,405 | 12/1998 | Aldous et al. | 208/211 |
| 5,853,569 | 12/1998 | Aldous et al. | 208/212 |

*Primary Examiner*—Walter D. Griffin
*Assistant Examiner*—Tam M Nguyen

[57] ABSTRACT

A method for producing a process oil is provided in which an aromatic extract oil is added to a paraffinic rich feed to provide a blended feed. The blended feed is then hydrotreated in a first hydrotreating stage to convert at least a portion of sulfur and nitrogen in the feed to hydrogen sulfide and ammonia. After stripping, the feed is subjected to a second hydrotreating stage to provide a process oil.

11 Claims, No Drawings

METHOD FOR MAKING A PROCESS OIL BY USING AROMATIC ENRICHMENT AND TWO PASS HYDROFINISHING

This application is a Continuation-in-Part of application Ser. No. 897,099 filed Jul. 18, 1997, now U.S. Pat. No. 5,846,405.

FIELD OF THE INVENTION

The present invention is concerned generally with the production of process oils from paraffinic rich feeds.

BACKGROUND OF THE INVENTION

The properties of paraffinic rich feeds render them useful in the manufacture of process oils. As is well known in the art, process oils are used in a wide variety of industrial applications. For example, they are used in processing natural and synthetic rubbers for a number of reasons such as reducing the mixing temperature during processing of the rubber and preventing scorching or burning of the rubber polymer when it is being ground down to a powder, or modifying the physical properties of the finished rubber and the like.

End-users of such process oils desire oils with increased solvency as indicated by a lower aniline point. Accordingly, one object of the present invention is to provide a process oil that has a lower aniline point and consequently increased solvency above what could be obtained from paraffinic distillates alone, by using paraffinic distillates in admixture with their coproduced extracts.

Due to the decline in the availability of naphthenic feeds, paraffinic distillates are being substituted for portions or all of some naphthenic distillates since the demand for higher solvency process oils is still increasing. Accordingly, it is another object of the present invention to provide process oils with increased solvency using lesser amounts of paraffinic rich feeds.

SUMMARY OF THE INVENTION

A method for producing a process oil is provided which comprises adding an aromatic containing extract oil to a paraffinic rich feed to provide a blended feed for processing; hydrotreating the feed in a first hydrotreating stage maintained at a temperature of about 300° C. to about 375° C. and a hydrogen partial pressure of about 300 to about 2500 psia to convert at least a portion of the sulfur in the feed to hydrogen sulfide and nitrogen in the feed to ammonia; stripping the hydrotreated feed from the first hydrotreating stage to remove hydrogen sulfide and ammonia; thereafter hydrotreating the hydrotreated feed in a second hydrotreating stage maintained at a temperature lower than the first stage in the range of about 275° C. to about 370° C. and a hydrogen partial pressure of about 300 to about 2500 psia to form a process oil.

These and other embodiments of the invention will become apparent from the reading of the detailed description of the invention which follows.

DETAILED DESCRIPTION OF THE INVENTION

Typically the paraffinic rich feed used to produce process oils in accordance with the method of the present invention will comprise virgin and/or synthetic hydrocarbons, although other paraffinic rich materials obtained by extraction or alkane or ketone dewaxing, catalytic dewaxing and the like may be utilized.

In accordance with the present invention, an aromatic extract oil is added to the paraffinic rich feed to provide a blended feed for hydrotreating. Preferably the aromatic extract oil used in the present invention will have an aniline point less than about 60° C. for high viscosity oils (e.g., greater than about 35 cSt @ 100° C.) and less than about 70° C. for low viscosity oils (e.g., about 2 cSt to about 35 cSt @ 100° C.).

Such an aromatic oil suitable in the process of the present invention is readily obtained by extracting a paraffinic rich feed such as a distillate with aromatic extraction solvents at temperatures in the range of about 50° C. to about 150° C. in extraction units known in the art. Typical aromatic extraction solvents include N-methylpyrrolidone, phenol, N,N dimethyl formamide, dimethylsulfoxide, methylcarbonate, morpholine, furfural and the like, preferably N-methylpyrrolidone or phenol. Solvent to oil treat ratios are generally from about 0.5:1 to about 3:1. The extraction solvent preferably contains water in the range from about 1 vol. % to about 20 vol. %. Basically the extraction can be conducted in a counter-current type extraction unit. The resultant aromatic rich solvent extract stream is then solvent stripped to provide an aromatic extract oil having an aromatic content in the range 50% to 90% by weight.

The aromatic extract oil is mixed with the same or different viscosity paraffinic rich feed in an extract to feed volume ratio in the range of about 10:90 to about 90:10, preferably 25:75 to 50:50. Typical, but not limiting examples of paraffinic and extract oils are provided in Tables 1 and 2 for low viscosity and high viscosity oils, respectively.

TABLE 1

LOW VISCOSITY PARAFFINIC FEED AND EXTRACT OIL - 75N

| | Paraffinic Feed | Extract Oil |
|---|---|---|
| Physical Properties (Waxy) | | |
| Density, 15° C. | 0.8866 | 0.9332 |
| Calc Viscosity cSt @ 100° C. | 3.2 | 3.6 |
| Refractive Index @ 75° C. | 1.4713 | 1.5021 |
| Aniline Point, ° C. | 81.3 | 53.0 |
| Pour Point, ° C. | 21.0 | 12.0 |
| Sulfur, wt. % | 1.2 | 2.0 |
| Dewaxed Viscosity Index @ −9° C. Pour | 71 | N/A* |
| Compositional Properties (Waxy) | | |
| Saturates, wt. % | 62 | 44 |
| Polars & Aromatics, wt. % | 38 | 56 |

*Viscosity Index of coproduced raffinate at −9° C. pour is 95

TABLE 2

HIGH VISCOSITY PARAFFINIC FEED AND EXTRACT OIL - 600N

| | Paraffinic Feed | Extract Oil |
|---|---|---|
| Physical Properties (Waxy) | | |
| Density 15° C. | 0.9327 | 0.9670 |
| Viscosity, cSt @ 100° C. | 17.7 | 42.2 |
| Refractive Index @ 75° C. | 1.5036 | 1.5511 |
| Aniline Point, ° C. | 90.3 | 44.0 |
| Pour Point, ° C. | 48.0 | 6.0 |
| Sulfur, wt. % | 1.7 | 3.0 |
| Dewaxed Viscosity Index @ −9° Pour | 39 | N/A* |

TABLE 2-continued

| HIGH VISCOSITY PARAFFINIC FEED AND EXTRACT OIL - 600N | | |
|---|---|---|
| | Paraffinic Feed | Extract Oil |
| Compositional Properties (Waxy) | | |
| Saturates, wt. % | 42 | 17 |
| Polars & Aromatics, wt. % | 58 | 83 |

*Viscosity Index of coproduced raffinate at −9° C. pour is 100

The result mixture is then subjected to hydrotreating in a first hydrotreating stage. The first hydrotreating stage preferably is maintained within the range of about 300° C. to 375° C. and more preferably within the range of 340° to 365° C. at a hydrogen partial pressure in the range from about 300 to about 2500 psia and preferably from 500 to 1200 psia. Hydrotreating is conducted in the first stage at a liquid hourly space velocity in the range from about 0.1 to about 2.0 v/v/hour and preferably from 0.5 to 1.0 v/v/hour, sufficient to convert at least a portion of the sulfur present in the feed to hydrogen sulfide and nitrogen in the feed to ammonia.

The hydrotreated feed from the first hydrotreating stage then is passed into an intermediate stripping stage, for example, to remove the hydrogen sulfide and ammonia.

Next the hydrotreated feed from the intermediate stripping stage is treated in a second hydrotreating stage which is maintained at a temperature in the range of about 275° C. to about 370° C. and preferably in the range of about 300° C. to about 330° C. at a hydrogen partial pressure of about 300 to about 2500 psia and preferably in the range of 500 to 1200 psia and at a space velocity of about 0.1 to about 2.0 v/v/hour, for a time sufficient to produce a process oil, for example, having an aniline point below about 65° C. for a low viscosity oil and below about 100° C. for a high viscosity oil.

The hydrotreating is effected conventionally under hydrogen pressure and with a conventional catalyst. Catalytic metals such as nickel, cobalt, tungsten, iron, molybdenum, manganese, platinum, palladium, and combinations of these supported on conventional supports such as alumina, silica, magnesia, and combinations of these with or without acid-acting substances such as halogens and phosphorous may be employed. A particularly preferred catalyst is a nickel molybdenum phosphorus catalyst supported on alumina, for example KF-840.

An optional dewaxing step could be conducted on the paraffinic rich feed or the hydrofinished product using catalytic dewaxing or alkane or ketone dewaxing.

What is claimed is:

1. A method for producing a process oil comprising:

adding an aromatic extract oil to a paraffinic rich feed to obtain a blended feed;

hydrotreating the blended feed in a first hydrotreating stage at a temperature in the range of about 300° C. to about 375° C., a hydrogen partial pressure of about 300 to about 2500 psia and a liquid hourly space velocity of about 0.1 to about 2.0 v/v/hr; to obtain a hydrotreated feed;

removing hydrogen sulfide and ammonia from the hydrotreated feed to obtain a stripped feed;

thereafter hydrotreating the stripped feed in a second hydrotreating stage at a lower temperature than the first stage and in the range of about 275° C. to about 370° C., a hydrogen partial pressure of about 300 to about 2500 psia and a space velocity of about 0.1 to about 2.0 v/v/hr whereby a process oil is produced.

2. The method of claim 1 wherein the paraffinic rich feed is a paraffinic distillate.

3. The method of claim 2 wherein the aromatic extract oil is added to the paraffinic feed in the volume ratio of about 10:90 to about 90:10.

4. The method of claim 3 wherein the volume ratio of aromatic extract oil to paraffinic feed in the blended feed is in the range of about 25:75 to about 50:50.

5. The method of claim 4 wherein the temperature in the first hydrotreating stage is in the range of 340° C. to 365° C. and in the second hydrotreating stage in the range of 300° C. to 330° C.

6. The method of claim 5 wherein the aromatic extract oil has an aromatic content of about 50% to about 90% by weight.

7. The method of claim 1 including dewaxing of the paraffinic rich feed or the process oil produced using catalytic dewaxing or alkane or ketone dewaxing.

8. A method for producing a process oil comprising:

(a) solvent extracting a paraffinic rich feed with an aromatic extraction solvent to obtain an aromatic rich solvent stream;

(b) removing the solvent from the aromatic rich solvent stream to obtain an aromatic rich extract oil;

(c) adding the aromatic rich extract oil to a paraffinic rich feed to obtain a blended feed;

(d) hydrotreating the blended feed in a first hydrotreating stage at a temperature in the range of about 300° C. to about 375° C., a hydrogen partial pressure of about 300 to about 2500 psia and a liquid hourly space velocity of about 0.1 to about 2.0 v/v/hr. to obtain a hydrotreated feed;

(e) removing hydrogen sulfide and ammonia from the hydrotreated blended feed to obtain a stripped feed;

(f) thereafter hydrotreating the stripped feed in a second hydrotreating stage at a lower temperature than the first stage and in the range of about 275° C. to to about 370° C., a hydrogen partial pressure of about 300 to about 2500 psig and a space velocity of about 0.1 to about 2.0 v/v/hr. whereby a process oil is produced.

9. The method of claim 8 of step (c) wherein the volume ratio of aromatic extract oil to paraffinic feed in the blended feed is in the range of about 10:90 to about 90:10.

10. The method of claim 9 wherein the volume ratio of aromatic extract oil to paraffinic feed is in the range of 25:75 to 50:50.

11. The method of claim 8 wherein the paraffinic rich feed of step (c) or the process oil produced in step (f) is dewaxed using catalytic dewaxing or alkane or ketone dewaxing.

* * * * *